US012158052B2

(12) United States Patent
Al-Ghannam et al.

(10) Patent No.: US 12,158,052 B2
(45) Date of Patent: Dec. 3, 2024

(54) FLOW BACK OPTION PLUG ASSEMBLY

(71) Applicant: SAUDI ARABIAN OIL COMPANY, Dhahran (SA)

(72) Inventors: Abdullah K. Al-Ghannam, Al-Ahsa (SA); Sanjiv Kumar, Jharkhand (IN)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/297,467

(22) Filed: Apr. 7, 2023

(65) Prior Publication Data

US 2024/0337168 A1 Oct. 10, 2024

(51) Int. Cl.

| | |
|---|---|
| ***E21B 33/12*** | (2006.01) |
| ***E21B 33/129*** | (2006.01) |
| ***E21B 33/134*** | (2006.01) |
| ***E21B 34/06*** | (2006.01) |

(52) U.S. Cl.

CPC ..... *E21B 33/12* (2013.01); *E21B 33/1293* (2013.01); *E21B 33/134* (2013.01); *E21B 34/063* (2013.01)

(58) Field of Classification Search

CPC .... E21B 33/12; E21B 34/063; E21B 33/1293; E21B 33/134

See application file for complete search history.

(56) References Cited

U.S. PATENT DOCUMENTS

| | | | | |
|---|---|---|---|---|
| 5,901,787 | A | 5/1999 | Boyle | |
| 7,806,189 | B2 | 10/2010 | Frazier | |
| 9,194,209 | B2 | 11/2015 | Frazier | |
| 10,107,070 | B2 | 10/2018 | Yong et al. | |
| 10,683,728 | B2 | 6/2020 | Kellner et al. | |
| 2013/0240203 | A1* | 9/2013 | Frazier | E21B 34/063 166/192 |
| 2014/0083689 | A1* | 3/2014 | Streich | E21B 34/102 166/250.15 |
| 2015/0285024 | A1* | 10/2015 | Sanchez | E21B 33/134 166/250.01 |
| 2018/0073321 | A1* | 3/2018 | Watson | E21B 33/124 |
| 2018/0363415 | A1 | 12/2018 | Frazier | |
| 2021/0054714 | A1* | 2/2021 | Nichols | E21B 33/1285 |
| 2022/0136358 | A1* | 5/2022 | Mitchell | E21B 33/128 166/387 |
| 2022/0205333 | A1* | 6/2022 | McFarlin | E21B 33/124 |

* cited by examiner

*Primary Examiner* — Brad Harcourt

(74) *Attorney, Agent, or Firm* — Osha Bergman Watanabe & Burton LLP

(57) ABSTRACT

A system includes a bridge plug for isolating a section of a wellbore. The bridge plug includes a cylindrical body and an engagement assembly mounted to an outer diameter of the cylindrical body and selectively extendible between a recessed position and an extended position. The system further includes a plug assembly for regulating flow through the cylindrical body of the bridge plug. The plug assembly includes a housing connected to the cylindrical body of the bridge plug, a frangible component that creates a seal within the housing, and a pin disposed within the housing and designed to fracture the frangible component.

19 Claims, 6 Drawing Sheets

FLOW BACK OPTION PLUG ASSEMBLY

BACKGROUND

Hydrocarbon resources are typically located below the earth's surface in subterranean porous rock formations, often called reservoirs. These hydrocarbon bearing reservoirs can be found in depths of tens of thousands of feet below the surface. In order to extract the hydrocarbon fluids, also referred to as oil and/or gas, wells may be drilled to gain access to the reservoirs. Wells may be drilled vertically from surface, deviated from vertical, or vertical to horizontal in order to most effectively and efficiently access the subsurface hydrocarbon reservoirs.

A step in the drilling operations, or well construction, involves casing the wellbore with tubulars and cementing the tubulars in place. This isolates the internal conduit or well from the surrounding formations, which may be prone to collapse or have undesirable hazards present such as shallow gas. Each section of the well is typically drilled with a drill bit that is attached to a length of drill string that extends from the bottom of the wellbore to the drilling rig at surface. Upon the completion of drilling a section of wellbore, the drilling string and drill bit are pulled out of the wellbore and a section of casing is deployed into the wellbore, which will be cemented into place creating the desired isolation from the newly drilled formation.

Once the well construction is complete, sections of the wellbore are isolated, including a scenario where there exist multiple producing formations and the preference is to produce each formation independently. A current solution for isolating sections of the wellbore is the deployment of a bridge plug. A bridge plug is a mechanical device that is deployed into a wellbore and anchored to the casing at a planned setting depth. The bridge plug prevents fluid flow across the device creating an isolation barrier within the wellbore. Some forms of bridge plugs may be non-permanent and will be dissolved, milled, or otherwise removed after a period of usage.

However, a bridge plug may also be used in other instances including to install a permanent barrier in addition to the already existing cemented casing in the wellbore in order to have redundancy. In addition, a bridge plug may be employed, along with cement plugs, to create an effective seal for permanently abandoning a well in the instance that the well has been depleted of hydrocarbon reserves and production is no longer economically viable. In doing so, hydrocarbons are prevented from inadvertently finding their way to the surface and creating a hazardous situation.

SUMMARY

One or more embodiments of the present invention relate to a system that includes a bridge plug for isolating a section of a wellbore. The bridge plug includes a cylindrical body and an engagement assembly mounted to an outer diameter of the cylindrical body and selectively extendible between a recessed position and an extended position. The system further includes a plug assembly for regulating flow through the cylindrical body of the bridge plug. The plug assembly includes a housing connected to the cylindrical body of the bridge plug, a frangible component that creates a seal within the housing, and a pin disposed within the housing and designed to fracture the frangible component.

One or more embodiments of the present invention relate to a method that includes connecting a cylindrical body of a bridge plug to a housing of a plug assembly, deploying the bridge plug and the plug assembly downhole in a wellbore, and actuating an engagement assembly of the bridge plug, thereby extending the engagement assembly from a recessed position to an extended position. The method further includes sealing the housing of the plug assembly with a frangible component of the plug assembly, regulating flow through the cylindrical body of the bridge plug with the plug assembly, isolating a section of the wellbore with the bridge plug, and fracturing the frangible component of the plug assembly with a pin disposed within the housing of the plug assembly.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

This disclosure describes systems and methods of isolating sections of a wellbore with the use of a bridge plug and a plug assembly. The techniques discussed in this disclosure are beneficial in reducing the total time of retrieving a bridge plug and, thus, the associated costs. In addition, the techniques discussed in this disclosure are beneficial as they may be employed in vertical, deviated, and horizontal wellbores.

Figure 1:
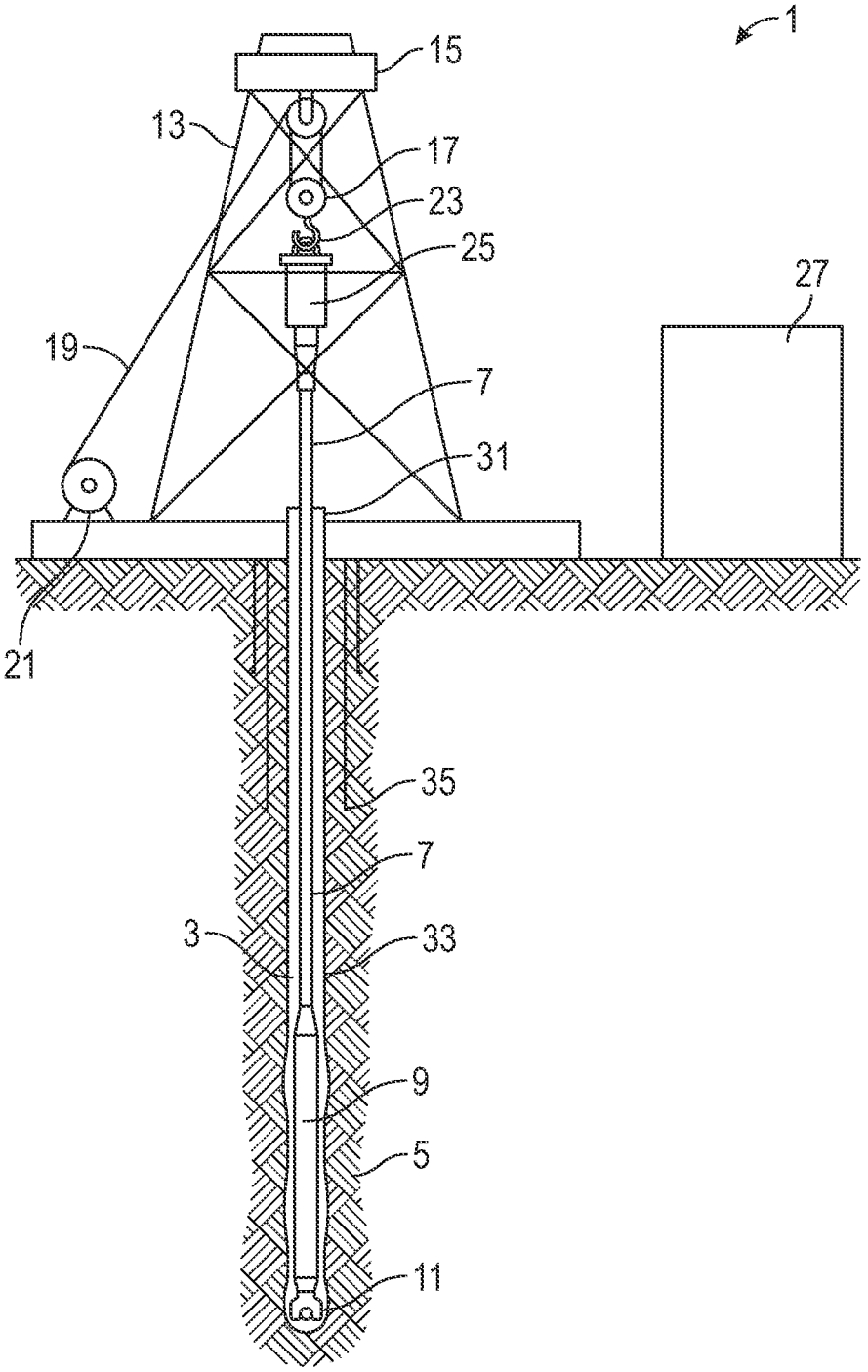
FIG. 1 shows an exemplary well site in accordance with one or more embodiments.

FIG. 1 illustrates an example of a well site 1. In general, well sites 1 have numerous different configurations. Therefore, the well site 1 is not intended to be limited with respect to the particular configuration of the drilling equipment depicted in FIG. 1. The well site 1 is shown as being on land. In other examples, the well site 1 could be shown as being offshore with the drilling being carried out with or without use of a marine riser. A drilling operation at a well site 1 includes drilling a wellbore 3 into a subsurface of various formations 5. In order to drill a new section of wellbore 3, a drill string 7 is suspended within the wellbore 3. The drill string 7 includes one or more drill pipes connected to form a conduit, and a bottom hole assembly (BHA) 9 disposed at the distal end of the conduit. For cutting into the subsurface rock, a drill bit 11 is utilized as a part of the BHA 9. Further, the BHA 9 includes measurement tools, such as a measurement-while-drilling (MWD) tool or a logging-while-drilling (LWD) tool, as well as other drilling tools that are not specifically shown but would be understood to a person skilled in the art.

A derrick structure 13 is used to suspend the drill string 7 in the wellbore 3. The top of the derrick structure 13 is mounted with a crown block 15. From the crown block 15, a traveling block 17 hangs down by means of a cable or drill line 19. One end of the drill line 19 is connected to a drawworks 21, which is a reeling device that adjusts the length of the drill line 19 so that the traveling block 17 is capable of moving up or down the derrick structure 13. The traveling block 17 includes a hook 23 that supports a top drive 25. The top drive 25 is coupled to the top of the drill string 7 and is operable to rotate the drill string 7. The drill string 7 is pumped with drilling fluid (commonly called mud) from a mud system 27. The mud flows into the drill string 7 through appropriate flow paths in the top drive 25. Details of the mud flow path have been omitted for simplicity but would be understood by a person skilled in the art.

During a drilling operation at the well site 1, in order to break rock, the drill string 7 is rotated relative to the wellbore 3 and weight is applied to the drill bit 11. In some cases, the drill bit 11 is rotated independently with a drilling motor. In other embodiments, the drill bit 11 is rotated using a combination of a drilling motor and the top drive 25 to rotate the drill string 7. Mud is pumped into the drill string 7 while the drill bit 11 cuts through the rock. The mud flows down the drill string 7 and exits through a nozzle in the drill bit 11 into the bottom of the wellbore 3. Once in the wellbore 3, the mud flows back up to a surface 31 in an annular space between the drill string 7 and the wellbore 3 carrying entrained cuttings to the surface 31. The mud with the cuttings is returned to the mud system 27 to be circulated back again into the drill string 7. Before pumping the mud again into the drill string 7, the cuttings are typically removed from the mud, and the mud is reconditioned as necessary.

Upon the retrieval of the drill string 7, the BHA 9, and the drill bit 11 from the wellbore 3, the drilling operations are complete. Subsequently, the production casing operations commence in some embodiments of wellbore 3 construction. In such instances, a casing 33 made up of one or more larger diameter tubulars that have a larger inner diameter than the drill string 7 but a smaller outer diameter than the wellbore 3 is lowered into the wellbore 3 on the drill string 7. The casing 33 is designed to isolate the internal diameter of the wellbore 3 from the adjacent formation 5. Once the casing 33 is positioned, it is set and cement is pumped down through the internal space of the casing 33, out of the bottom of a casing shoe 35, and into the annular space between the wellbore 3 and the outer diameter of the casing 33. This creates the desired isolation between the wellbore 3 and the formation 5 and secures the casing 33 in place. Afterwards, the drilling of the next section of the wellbore 3 begins.

Figure 2:
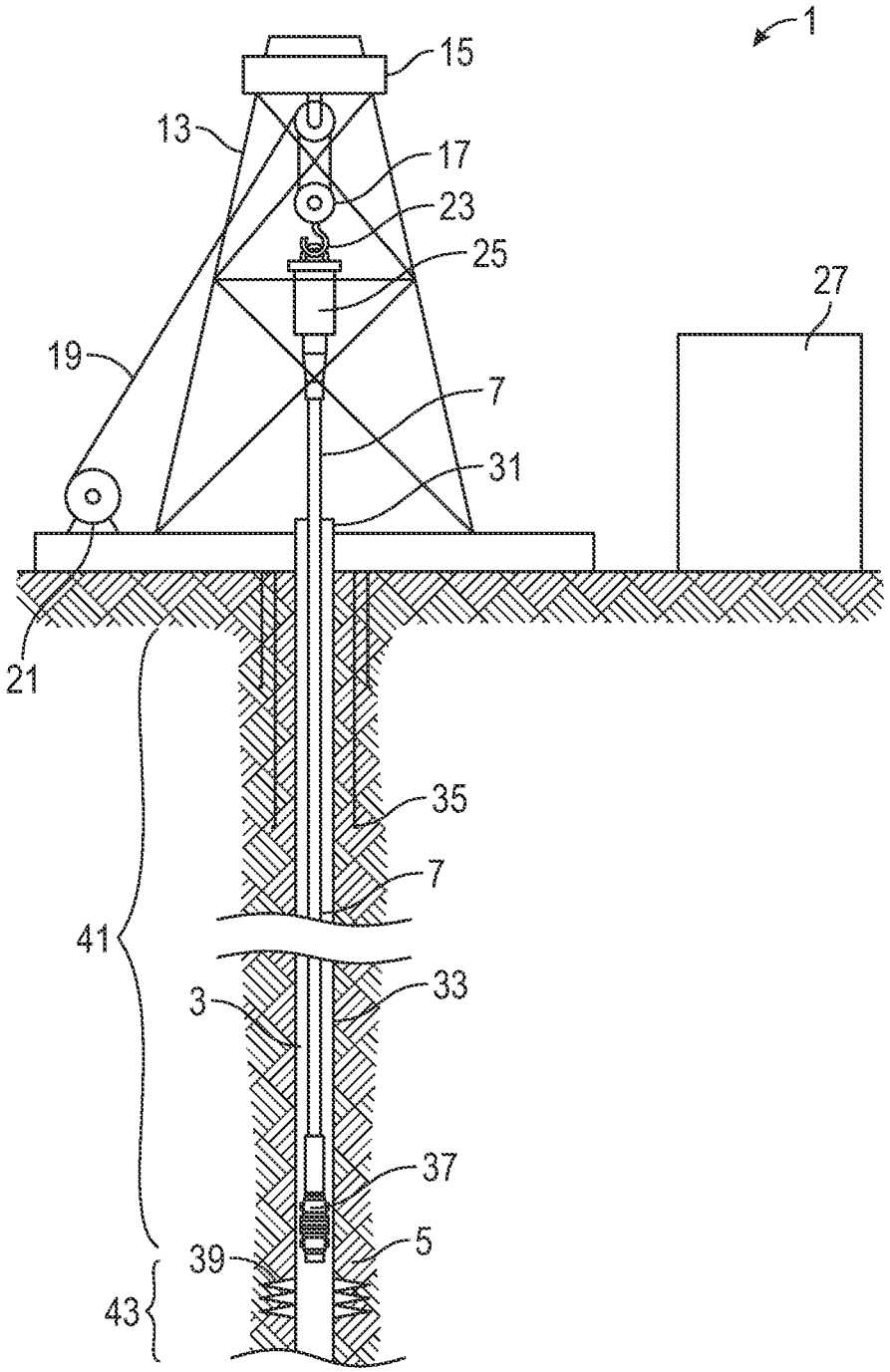
FIG. 2 shows an exemplary well site that includes a bridge plug in accordance with one or more embodiments.

FIG. 2 illustrates an example of a well site 1 that includes a bridge plug 37. Here, the bridge plug 37 has been deployed in the wellbore 3 by the drill string 7. Alternatively, a bridge plug 37 may be deployed downhole in the wellbore 3 by an electric wireline, slickline, or coiled tubing. Further, the bridge plug 37 is shown as being set at a planned setting depth above perforations 39 of the wellbore 3. Bridge plugs 37 and packers are typically used to permanently or temporarily isolate two or more sections within a wellbore 3. Isolation within the wellbore 3 may be desired in order to pressure test, perforate, frac, replace surface control equipment, or stimulate a section of the wellbore 3 without impacting or communicating with other sections within the wellbore 3. Here, the bridge plug 37 isolates a first section 41 of the wellbore 3, disposed above the bridge plug 37, from a second section 43 of the wellbore 3, disposed below the bridge plug 37.

After completion the operation requiring isolation, in order to reopen the wellbore 3 and restore fluid communication from all sections 41, 43, both above and below the bridge plug 37 and/or packer, the bridge plug 37 and/or packer may be removed or otherwise compromised. In order to remove permanent bridge plugs 37, the permanent bridge plugs 37 are typically drilled or milled through.

Alternatively, bridge plugs 37 that are retrievable, referred to as "retrievable bridge plugs 37," generally include slips and sealing elements to securely anchor the bridge plug 37 within the wellbore 3, as well as a retrieving mechanism to remove the bridge plug 37 from the wellbore 3. In order to retrieve a retrievable bridge plug 37 from the wellbore 3, a retrieval tool is lowered from the surface 31 into the wellbore 3 to engage the retrieving mechanism (not shown) on the bridge plug 37. Upon activation of the retrieving mechanism, the slips and the sealing elements of the bridge plug 37 retract, thereby permitting the bridge plug 37 to be returned to the surface 31.

A common issue associated with retrievable bridge plugs 37 is the accumulation of debris on the top of the bridge plug 37. Debris on the top of the bridge plug 37 may cause difficultly when attempting to engage the retrieving mechanism of the bridge plug 37. In addition, debris within the wellbore 3 may also adversely affect the movement of the slips and/or sealing elements. In such instances, only partial disengagement from the wellbore 3 may be permitted. Consequently, difficulties in removing a retrievable bridge plug 37 frequently lead to bridge plugs 37 being drilled or milled through in order to remove the plug set in the wellbore 3.

It is known for some bridge plugs 37 to utilize sealing disks formed of brittle materials that may be physically fractured by dropping a weighted bar via wireline into the casing 33. The dropping of weighted bars may be a rapid and efficient removal method of the sealing disks within vertical wellbores 3, however in deviated, or horizontal wellbores 3, the weighted bars are ineffective at removing sealing solutions. Further, weighted bars may be ineffective at removing sealing solutions when debris has accumulated within the wellbore 3. As such, embodiments disclosed herein present systems and methods of isolating sections 41, 43 of a wellbore 3 with the use of a bridge plug 37 and a plug assembly. The bridge plug 37 may include a cylindrical body and an engagement assembly. The plug assembly may include a housing, a frangible component, and a pin. The system may regulate flow through the system without the use of a rig in order to clean any fill and/or debris situated on top of the system, thereby minimizing the time and costs associated with retrieving the system.

Figure 3:
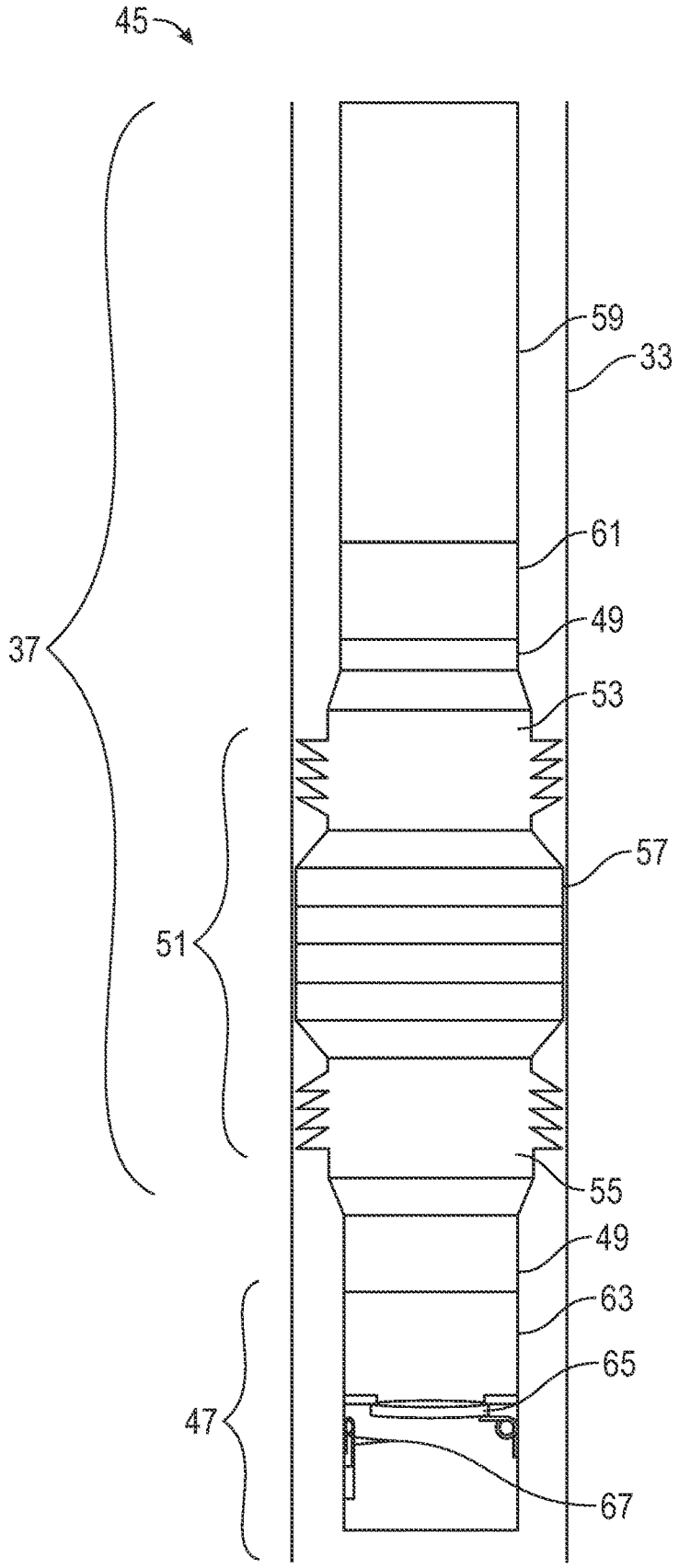
FIG. 3 shows a cross-sectional view of a system in accordance with one or more embodiments of the present disclosure.

FIG. 3 shows a cross-sectional view of a system 45 in accordance with one or more embodiments of the present disclosure. Here, the system 45 includes a bridge plug 37 and a plug assembly 47. The bridge plug 37 anchors to the inside of the casing 33 of the wellbore 3 and includes a cylindrical body 49 and an engagement assembly 51. When set, the bridge plug 37 creates an isolation barrier in the wellbore 3 below the bridge plug 37.

In the non-limiting example of FIG. 3, the bridge plug 37 is a temporary bridge plug 37. As such, the cylindrical body 49 of the bridge plug 37 may be formed of a durable metallic material, such as stainless-steel alloys, carbon steel alloys, or ductile iron. However, and in the case that the bridge plug 37 is a permanent bridge plug 37, the cylindrical body 49 may be formed of a brittle material such as a ceramic, cast iron, cast aluminum, or an engineered composite material which may be drilled or milled through. In either instance, the cylindrical body 49 may include a bore throughout the length of the cylindrical body 49.

The engagement assembly 51 is disposed on the outer diameter of the cylindrical body 49 and may include upper slips 53, lower slips 55, and at least one packer 57. The slips 53, 55 and the packer 57 are employed to anchor and isolate the bridge plug 37, respectively, in place within the casing 33. The upper slips 53 and lower slips 55 may be sets of tapered elements. In an extended position, the tapered elements of the upper slips 53 and the lower slips 55 are forced outwardly from the cylindrical body 49 against the casing 33, as shown in FIG. 3. The packer 57, often formed of elastomeric materials, may be any packer 57 known in the art such as a mechanical packer. Further, when the packer 57 is in the extended position, the packer 57 seals a space located between the bridge plug 37 and the casing 33. In this way, the packer 57 applies a radial outward force that seals the packer 57 against the inside of the casing 33, creating an isolation barrier and isolating the wellbore 3 below the bridge plug 37. Further, gauge rings (not shown) may be provided above and below the upper slips 53 and lower slips 55 to protect any wear from occurring when running the bridge plug 37 in-hole.

In one or more embodiments, the bridge plug 37 further includes a setting sleeve 59. This may be the case if the system 45 is deployed in the wellbore 3 by the drill string 7. The setting sleeve 59 is located at an upper end of the bridge plug 37 and may be attached to the drill string 7 during deployment. In addition, the setting sleeve 59 is employed to selectively actuate the slips 53, 55 and packer 57 of the engagement assembly 51. Specifically, by applying right hand rotation and then setting down weight on the bridge plug 37 by the drill string 7, the lower slips 55 are shifted from a recessed position to the extended position, thereby gripping in internal diameter of the casing 33. Subsequently, an upward force is applied to the setting sleeve 59 by the drill string 7 which shears a set of shear pins (not shown) of the packer 57 and upper slips 53. As the setting sleeve 59 moves upwards, the packer 57 is extended from a recessed position and pushed against the internal diameter of the casing 33. In addition, the upper slips 53 are shifted to this extended position. In this way, the actuation of the setting sleeve 59 results in the bridge plug 37 being anchored to the internal diameter of the casing 33. Furthermore, additional upward tension may be applied on the setting sleeve 59 by the drill string 7, collapsing a retrieval busing (not shown) and releasing the drill string 7 from the setting sleeve 59.

Alternatively, in the instance the system 45 was deployed by a wireline or coiled tubing, one or more embodiments of the bridge plug 37 may include a setting tool (not shown). The setting tool may be any setting tool known in the art.

In one or more embodiments, the bridge plug 37 may further include a fishing neck 61. The fishing neck 61 may be disposed between the setting sleeve 59 and the cylindrical body 49 of the bridge plug 37. Alternatively, the fishing neck 61 may be formed integrally as a part of the setting sleeve 59 or the cylindrical body 49. The fishing neck 61 may include an internal groove set to be caught by a collet disposed upon a retrieval tool (not shown) of the system 45. As such, when the system 45 is to be returned to the surface 31, the retrieval tool is lowered in the wellbore 3 to the system 45 and attaches to the fishing neck 61. The retrieval tool may be any retrieval tool known in the art. Subsequent to the engagement assembly 51 retracting from the casing 33, the system 45 may be returned to the surface 31 by the retrieval tool.

The plug assembly 47 regulates flow through the cylindrical body 49 of the bridge plug 37 and includes a housing 63, a frangible component 65, and a pin 67. The housing 63 is tubular shaped with openings at both the upper end and the lower end, and may be formed of a similar material as the cylindrical body 49 of the bridge plug 37. The frangible component 65 serves to create a seal within the housing 63 when intact and may be formed of a ceramic, polymer, carbon fiber, fiberglass, epoxy, or any combination thereof. Further, the pin 67 of the plug assembly 47 is employed to selectively fracture the frangible component 65, thereby breaking the seal formed by the frangible component 65 within the housing 63. The pin 67 may be formed of a durable material, such as a hard metal like steel or of a polymer. The structure of the plug assembly 47 is further detailed in FIG. 4, which shows a cross-sectional view of the system 45, in accordance with one or more embodiments of the present disclosure.

Figure 4:
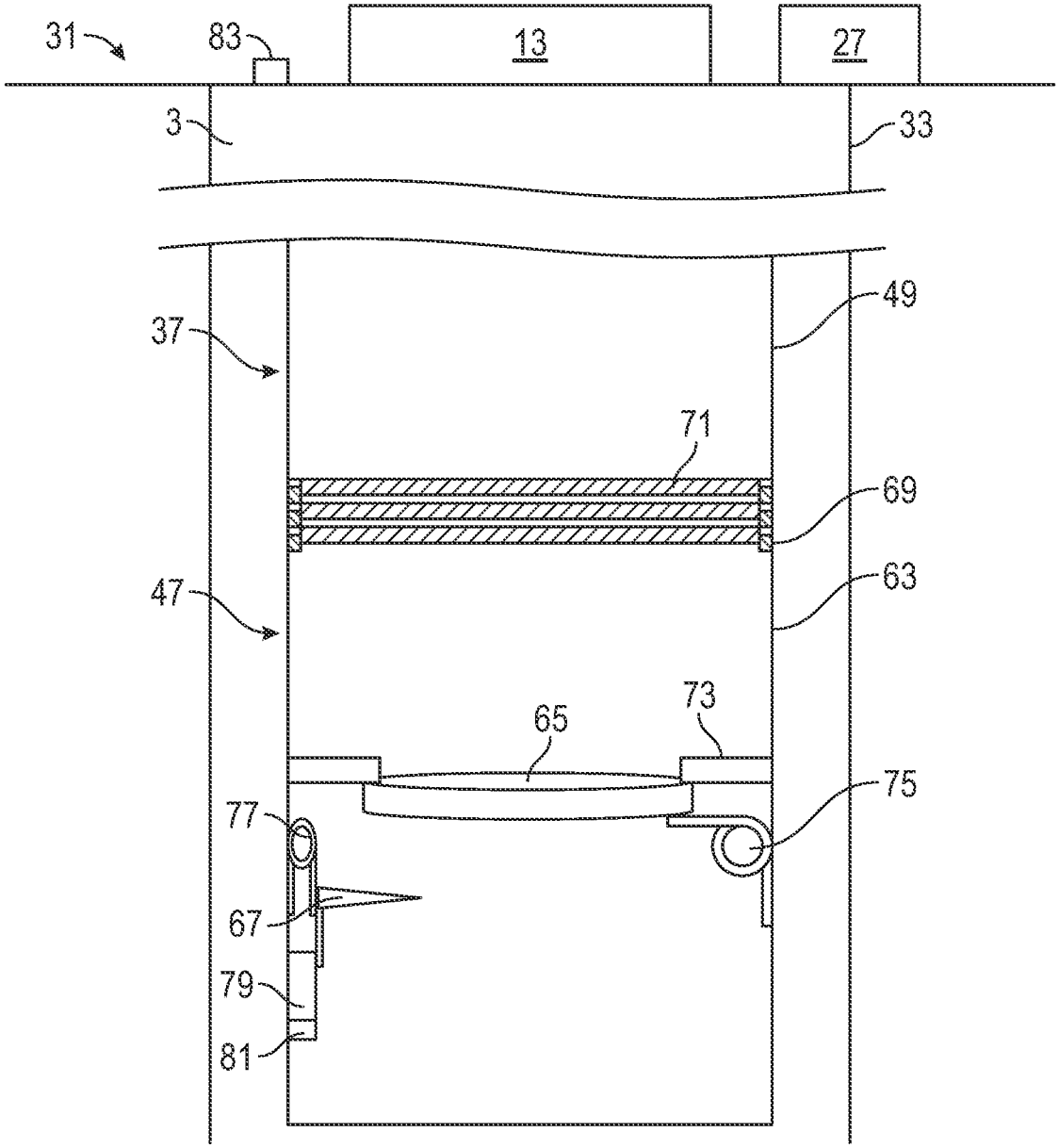
FIG. 4 shows a cross-sectional view of a system in accordance with one or more embodiments of the present disclosure.

FIG. 4 depicts a cross-sectional view of the system 45 in accordance with one or more embodiments of the present disclosure. The plug assembly 47 is disposed below the bridge plug 37. The housing 63 is connected to and in fluid communication with the cylindrical body 49 of the bridge plug 37. In one or more embodiments, the housing 63 of the plug assembly 47 may include a threaded connection 69 at the upper end of the housing 63 that connects with a complementary threaded connection 71 disposed on the lower end of the cylindrical body 49 of the bridge plug 37. Here, the complementary threaded connection 71 of the cylindrical body 49 fits within the threaded connection 69 of the housing 63. However, in one or more embodiments, the threaded connection 69 of the housing 63 may fit inside the complementary threaded connection 71 of the cylindrical body 49. Additionally, an outer diameter of the housing 63 of the plug assembly 47 may be a same diameter or a smaller diameter as the outer diameter of the cylindrical body 49 of the bridge plug 37.

The housing 63 of the plug assembly 47 may further include a protrusion 73 along an interior wall of the housing 63. The protrusion 73 may be annular, extending the circumference of the interior wall of the housing 63, and formed of a similar material as the housing 63. As such, the protrusion 73 serves to position the frangible component 65 within the housing 63. Prior to the system 45 being deployed, the frangible component 65 is placed against a lower surface of the protrusion 73 within the housing 63. The frangible component 65 may be held against the lower surface of the protrusion 73, thereby creating a seal within the housing 63, by a securing mechanism 75. In the non-limiting example of FIG. 4, the securing mechanism 75 is a torsion spring. However, the securing mechanism 75 may be a plurality of springs, a plurality of hooks, or another mechanical means for removably securing and pressing the frangible component 65 against lower surface of the protrusion 73.

The torsion spring may be formed of formed of high-carbon, alloy, or stainless steel. A first end of the securing mechanism 75 may be fixed to the interior wall of the housing 63 below the protrusion 73. A second end of the securing mechanism 75 may contact the frangible component 65, thereby pressing and securing the frangible component 65 against the protrusion 73. In addition, a sealing element (not shown) may be disposed along the lower surface of the protrusion 73. The sealing element may be annular and formed of an elastomeric material. Accordingly, the sealing element is pinned between the protrusion 73 and the frangible component 65 when the frangible component 65 is pressed towards the lower surface of the protrusion 73 by the securing mechanism 75. In this way, the sealing element and the frangible component 65 create a sealed barrier within the housing 63 that isolates the housing 63 above the protrusion 73 and the interior of the cylindrical body 49 of the bridge plug 37 from the wellbore 3 below the system 45.

In one or more embodiments, the frangible component 65 may be embodied as a ceramic disk. As such, the frangible component 65 may have a diameter extending between an inner diameter of the housing 63 and an inner diameter of the protrusion 73. The seal created by the frangible component 65 in the housing 63 may be broken when the frangible component 65 is fractured. The pin 67 of the plug assembly 47 is designed to selectively fracture the frangible component 65. In one or more embodiments, the pin 67 may be driven through the frangible component 65 by a driving mechanism. In the non-limiting example of FIG. 4, the driving mechanism is a driving spring 77. However, the driving mechanism may be a piston, linear actuator, or another mechanical means capable of driving the pin 67 through the frangible component 65.

The driving spring 77 may be a torsion spring and formed of high-carbon, alloy, or stainless steel. A first end of the driving spring 77 may be fixed to the interior wall of the housing 63. The pin 67 may be fixed to a second end of the driving spring 77. Prior to being deployed, the driving spring 77 is placed in a loaded position. That is, the second end of the driving spring 77 is bent towards the first end of the driving spring 77. The second end of the driving spring 77 is held in the loaded position by a release tool 79, as seen in FIG. 4. In one or more embodiments, the release tool 79 may be a servo motor or a linear actuator. In addition, the release tool 79 may be powered by a battery (not shown). Further, the release tool 79 may include a receiver 81. The receiver 81 is designed to operate the release tool 79. Upon receiving a signal from a transmitter 83 disposed at the surface 31, the receiver 81 may instruct the release tool 79 to operate, thereby releasing the driving spring 77 from the loaded position. The transmitter 83 may transmit the signal to the receiver 81 wirelessly by any method known in the art. Subsequently, the driving spring 77 may extend, moving the second end of the driving spring 77 towards the frangible component 65, permitting the pin 67 to fracture the frangible component 65.

Figure 5C:
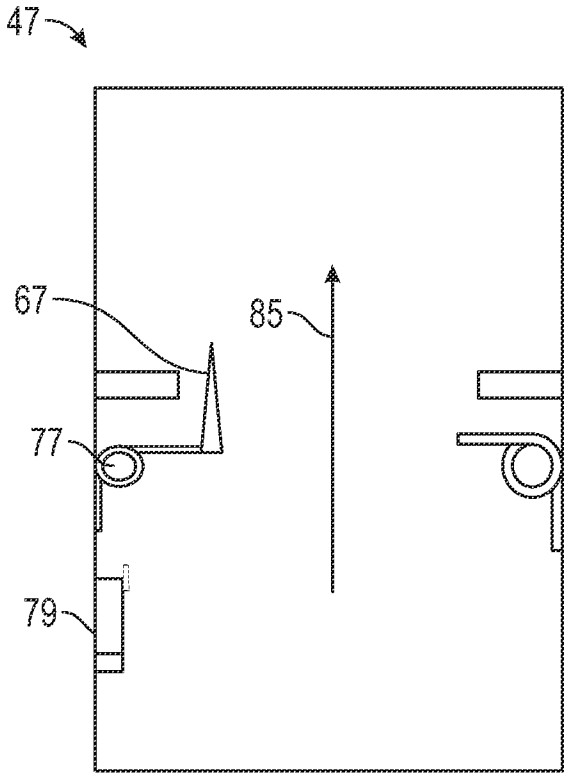
FIGS. 5A-5C depict the operational sequence of a plug assembly in accordance with one or more embodiments.
Figure 5B:
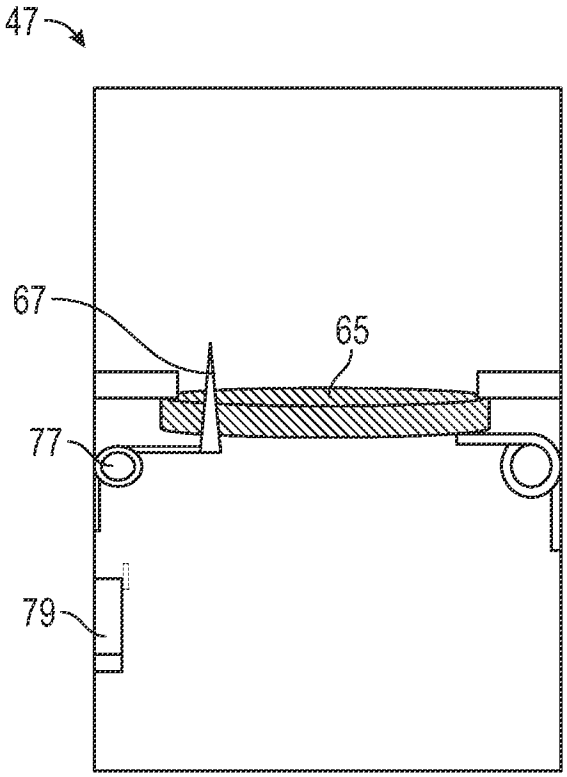
Figure 5A:
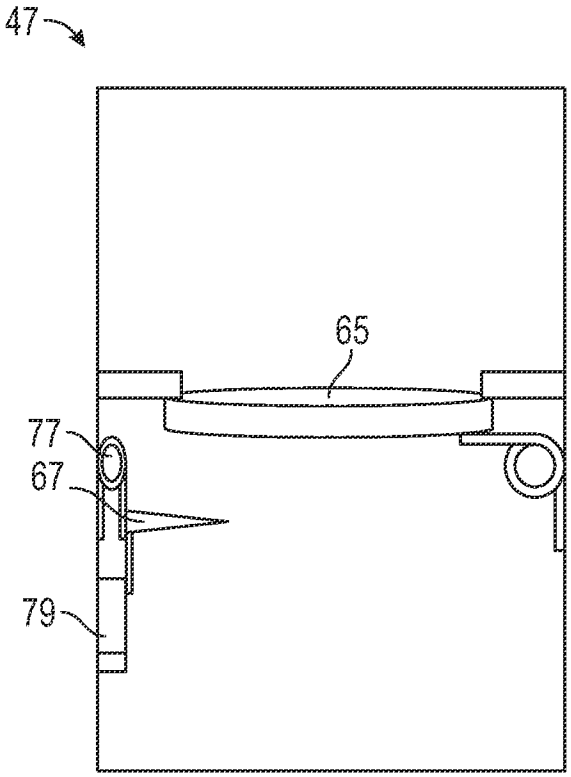

FIGS. 5A-5C depict the operational sequence of the plug assembly 47 in accordance with one or more embodiments. Specifically, FIG. 5A depicts the plug assembly 47 prior to actuation of the release tool 79. Here, the frangible component 65 is intact and is pressed against the protrusion 73 of the housing 63 by the securing mechanism 75. As such, the frangible component 65 forms a seal within the housing 63 of the plug assembly 47, thereby isolating the housing 63 above the protrusion 73 and the interior of the cylindrical body 49 from the wellbore 3 below the system 45. In this way, the system 45 may temporarily isolate a first section 41 of the wellbore 3 above the system 45 and a second section 43 of the wellbore 3 below the system 45. This isolation within the wellbore 3 may permit a number of operations to be ran within the first section 41 of the wellbore 3 without impacting or communicating with the second section 43 of the wellbore 3.

In FIG. 5B, the release tool 79 has been actuated. That is, a signal has been sent by the transmitter 83 at the surface 31 to the receiver 81 of the release tool 79, thereby actuating the release tool 79. Accordingly, upon actuation of the release tool 79, the release tool 79 releases the driving spring 77 from the loaded position. Once released, the driving spring 77 extends from the loaded position to an extended position, as seen in FIG. 5B. In turn, the driving spring 77 drives the pin 67 through the frangible component 65, thereby fracturing the frangible component 65.

The transmitter 83 may signal to the receiver 81 of the release tool 79 subsequent to completion of the operation requiring isolation within the wellbore 3 or when a crew of the well site 1 determines to remove the system 45 from the wellbore 3.

Subsequent to the frangible component 65 fracturing, the frangible component 65 may break into a number of separate pieces. In addition, fluid communication is restored between the first section 41 of the wellbore 3 and the second section 43 of the wellbore 3 through the system 45. Specifically, subsequent to the seal created by the frangible component 65 within the housing 63 breaking, a passage is formed extending from the opening of the lower end of the housing 63 of the plug assembly 47 to an opening of the upper end of the bridge plug 37. The opening of the upper end of the bridge plug 37 may be an opening of the upper end of the cylindrical body 49 or an opening of the upper end of the setting sleeve 59 if a setting sleeve 59 is employed.

In FIG. 5C, flow is restored throughout the wellbore 3. At the surface 31, valves (not shown) of the well site 1 may be opened such that pressure within the wellbore 3 lifts fluid within the wellbore 3 to the surface 31. In FIG. 5C, a direction 85 of the flow is depicted as traveling uphole from below the system 45 to the surface 31, passing through the interiors of the plug assembly 47 and the bridge plug 37. Consequently, as the flow travels uphole towards the surface 31, the broken pieces of the frangible component 65 are lifted by the flow to the surface 31 to be removed from the wellbore 3. In addition, fill and/or debris disposed upon the bridge plug 37 is also lifted by the flow to the surface 31. Advantageously, the success rate of a retrieving tool engaging the system 45 is increased.

Figure 6:
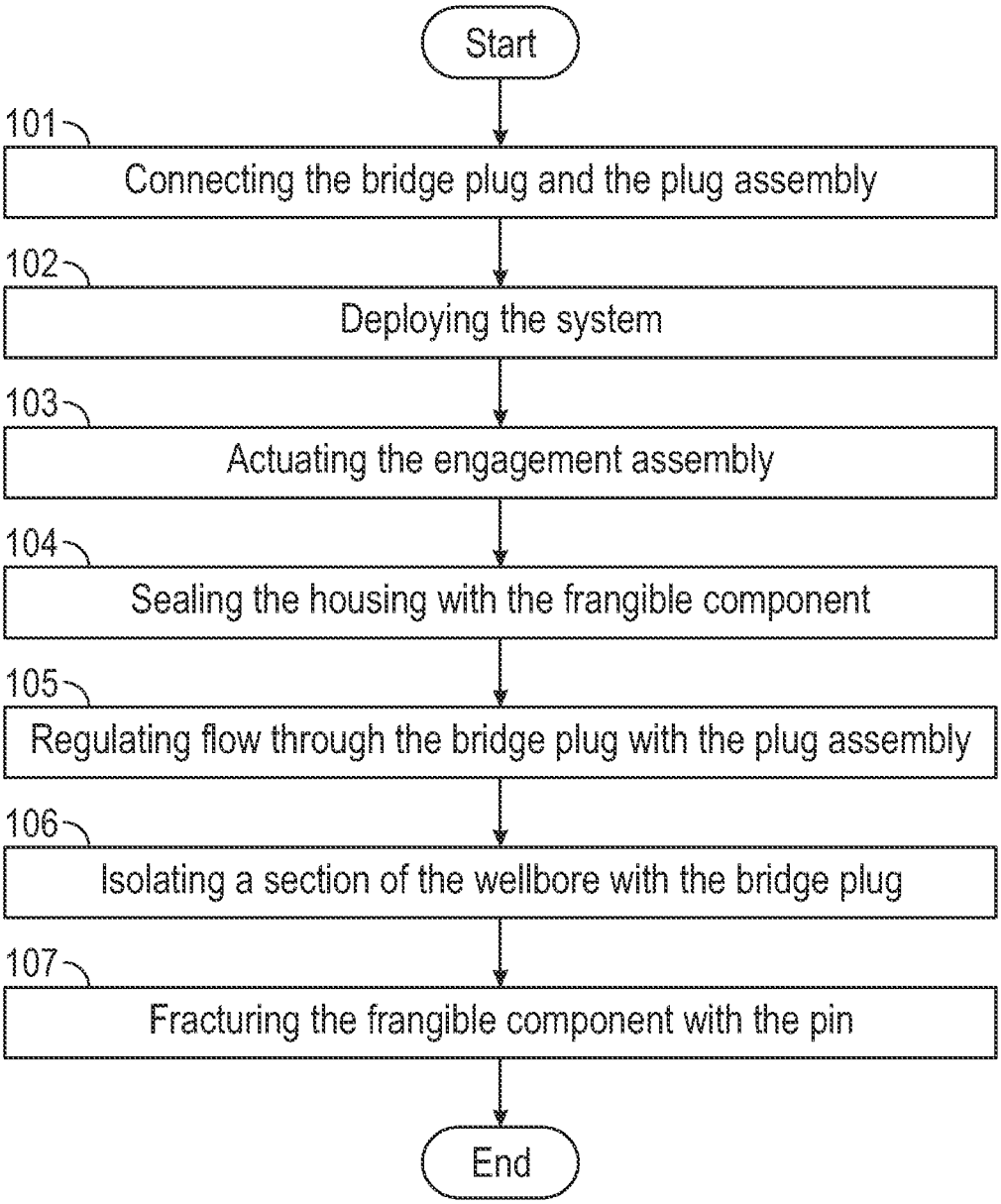
FIG. 6 shows a flowchart of a method in accordance with one or more embodiments of the present disclosure.

FIG. 6 depicts a flowchart showing a method for isolating sections 41, 43 of a wellbore 3 with the use of a bridge plug 37 and a plug assembly 47. While the various flowchart blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 101, the bridge plug 37 and the plug assembly 47 are connected. The bridge plug 37 and the plug assembly 47 may be connected to one another at the surface 31 prior to deploying the system 45. In one or more embodiment, the housing 63 of the plug assembly 47 is connected to the cylindrical body 49 of the bridge plug 37 by a threaded connection 69. That is, a threaded connection 69 of the housing 63 may be connected to a complementary threaded connection 71 of the cylindrical body 49. Further, the plug assembly 47 is attached to the lower end of the bridge plug 37.

In block 102, the system 45 is deployed downhole in the wellbore 3. That is, the system 45 is lowered downhole in the wellbore 3 to a desired depth. The desired depth of the system 45 may be predetermined prior to deploying the system 45. Further, the system 45 may be deployed in the wellbore 3 by the drill string 7, a wireline, or coiled tubing.

In block 103, subsequent to the system 45 reaching the desired setting depth, the engagement assembly 51 of the bridge plug 37 is actuated. In one or more embodiments, the engagement assembly 51 is actuated by an interaction between the drill string 7 and a setting sleeve 59 disposed along the bridge plug 37 above the cylindrical body 49. Alternatively, in one or more embodiments, the engagement assembly 51 is actuated by a setting tool (not shown) disposed above the cylindrical body 49. In either case, the upper slips 53 and the lower slips 55 of the engagement assembly 51 are extended from a recessed position to an extended position. In the extended position, the slips 53, 55 are driven into the casing 33, securing the system 45 against the casing 33. Further, the packer 57 of the engagement assembly 51 is expanded from a recessed position to an extended position. In the extended position, the packer 57 is pushed against the casing 33, thereby sealing the wellbore 3 between the bridge plug 37 and the casing 33.

In block 104, the frangible component 65 creates a seal within the housing 63 of the plug assembly 47. That is, the frangible component 65 is pressed against the protrusion 73 of the housing 63 by a securing mechanism 75, thereby creating a sealing barrier between the housing 63 above the protrusion 73 and the housing 63 below the protrusion 73. The plug assembly 47 may include a sealing element (not shown) disposed between the protrusion 73 and the frangible component 65. In one or more embodiments, the securing mechanism 75 of the plug assembly 47 may be a torsion spring.

In block 105, flow is regulated through the bridge plug 37 with the use of the plug assembly 47. That is, with the frangible component 65 intact and creating a seal within the housing 63 of the plug assembly 47, flow is prevented from traveling from the plug assembly 47 into the bridge plug 37. However, when the frangible component 65 of the plug assembly 47 is broken, the housing 63 of the plug assembly 47 and the cylindrical body 49 of the bridge plug 37 are in fluid communication and flow may pass from the second section 43 of the wellbore 3 into the first section 41 of the wellbore 3 through the system 45.

In block 106, prior to the frangible component 65 being fractured, the seal created between the protrusion 73 and the frangible component 65 isolates the first section 41 of the wellbore 3 above the system 45 from flow from the second section 43 of the wellbore 3 below the system 45. In this way, when the frangible component 65 of the plug assembly 47 is intact, flow is prevented from passing through the system 45. In addition, the engagement assembly 51 of the bridge plug 37 prevents flow outside the system 45 from the second section 43 of the wellbore 3 from traveling to the first section 41 of the wellbore 3.

In block 107, the frangible component 65 is fractured by the pin 67 of the plug assembly 47. The pin 67 of the plug assembly 47 may be driven through the frangible component 65, thereby fracturing the frangible component 65, upon completion of a well site 1 operation. As such, when the crew of the well site 1 decides to restore fluid communication between the first section 41 of the wellbore 3 and the second section 43 of the wellbore 3, a signal is sent from the surface 31 by a transmitter 83 to the receiver 81 of the release tool 79. In one or more embodiments, the signal may be sent wirelessly from the transmitter 83 to the receiver 81. Alternatively, a BHA 9 including a transmitter 83 may be deployed downhole by a slickline or an electric wireline. Details of running a BHA 9 have been omitted for simplicity but would be understood by a person skilled in the art.

Upon receiving the signal from the transmitter 83, the receiver 81 actuates the release tool 79, thereby causing the release tool 79 to release the driving spring 77 of the plug assembly 47 from the loaded position. Once released, the driving spring 77 expands and drives the pin 67 of the plug assembly 47 into the frangible component 65. The force at which the pin 67 strikes the frangible component 65 causes the frangible component 65 to fracture.

Subsequent to fracturing, the frangible component 65 breaks into a number of separate pieces. In turn, the seal formed between the protrusion 73 and the frangible component 65 within the housing 63 is broken. Consequently, fluid communication is restored between the first section 41 of the wellbore 3 and the second section 43 of the wellbore 3 through the system 45.

Once flow is restored throughout the wellbore 3, valves may be opened at the surface 31 permitting pressure within the wellbore 3 to lift fluid towards the surface 31. Accordingly, as the fluid travels uphole in the wellbore 3 towards the surface 31, the flow brings the broken pieces of the frangible component 65 and debris previously disposed upon the system 45 to the surface 31 to be removed from the wellbore 3.

Subsequently, a fishing operation may be run to retrieve the system 45 to the surface 31. In one or more embodiments, a retrieving tool (not shown) may be lowered into the system 45, thereby engaging the fishing neck 61 of the system 45. Once the fishing neck 61 is secured to the retrieving tool, the retrieving tool may actuate a retrieving mechanism (not shown) and the engagement assembly 51 may disengage from the casing 33. Specifically, the upper slips 53, the lower slips 55, and the packer 57 may retract from the extended position back to the recess position, thereby permitting the system 45 to be returned to the surface 31.

Furthermore, in one or more embodiments, the system 45 may be deployed again downhole subsequent to a new frangible component 65 being installed within the plug assembly 47. In one or more embodiments, the plug assembly 47 may be connected to a different bridge plug 37 before being deployed again, subsequent to a new frangible component 65 being installed within the plug assembly 47.

Accordingly, the aforementioned embodiments as disclosed relate to systems 45 and methods useful for isolating sections 41, 43 of a wellbore 3 with the use of a bridge plug 37 and a plug assembly 47. The aforementioned embodiments may regulate flow through the system 45 without the use of a rig in order to clean any fill and/or debris situated on top of the system 45, thereby minimizing the time and costs associated with retrieving the system 45. The disclosed systems 45 and methods of isolating sections 41, 43 of a wellbore 3 with the use of a bridge plug 37 and a plug assembly 47 advantageously cater to areas and fields which suffer from continuous fill accumulating on top of bridge plugs 37. Further, the disclosed systems 45 and methods are advantageously operational in vertical, deviated, and horizontal wellbores 3.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system, comprising:

a bridge plug configured to isolate a section of a wellbore, the bridge plug comprising:

a cylindrical body;

an engagement assembly mounted to an outer diameter of the cylindrical body and selectively extendible between a recessed position and an extended position; and a plug assembly configured to regulate flow through the cylindrical body of the bridge plug, the plug assembly comprising:

a housing;

a frangible component configured to create a seal within the housing; and a pin disposed within the housing, the pin configured to fracture the frangible component;

wherein the housing of the plug assembly is cylindrical and comprises an outer diameter that is a same diameter as the outer diameter of the cylindrical body of the bridge plug, and wherein an upper end of the housing is connected to a lower end of the cylindrical body of the bridge plug.

2. The system according to claim 1, wherein the bridge plug is a retrievable bridge plug and further comprises a fishing neck.

3. The system according to claim 1, wherein the engagement assembly comprises upper slips, lower slips, and at least one packer.

4. The system according to claim 1, wherein the housing of the plug assembly further comprises a protrusion configured to position the frangible component within the housing.

5. The system according to claim 1, wherein the frangible component of the plug assembly is embodied as a ceramic disk.

6. The system according to claim 1, wherein the bridge plug further comprises a setting sleeve configured to actuate the engagement assembly of the bridge plug.

7. The system according to claim 6, wherein the setting sleeve of the bridge plug is disposed at an upper end of the bridge plug.

8. The system according to claim 1, wherein the housing of the plug assembly comprises a threaded connection along the upper end of the housing.

9. The system according to claim 8, wherein the cylindrical body of the bridge plug comprises a complementary threaded connection to the threaded connection of the housing of the plug assembly along the lower end of the cylindrical body.

10. The system according to claim 1, wherein the plug assembly further comprises:

a driving spring configured to move the pin within the housing when released; and a release tool configured to release the driving spring when actuated.

11. The system according to claim 10, wherein the plug assembly further comprises a transmitter configured to transmit an actuation signal to the release tool.

12. The system according to claim 11, wherein the actuation signal of the transmitter is wirelessly transmitted to the release tool by the transmitter.

13. A method, comprising:

connecting an upper end of a housing of a plug assembly to a lower end of a cylindrical body of a bridge plug, the housing having an outer diameter that is a same diameter as an outer diameter of the cylindrical body;

deploying the bridge plug and the plug assembly downhole in a wellbore;

actuating an engagement assembly of the bridge plug, thereby extending the engagement assembly from a recessed position to an extended position;

sealing, by a frangible component of the plug assembly, the housing of the plug assembly;

regulating, by the plug assembly, flow through the cylindrical body of the bridge plug;

isolating, by the bridge plug, a section of the wellbore; and fracturing the frangible component of the plug assembly by a pin disposed within the housing of the plug assembly.

14. The method according to claim 13, further comprising actuating a setting sleeve of the bridge plug in order to actuate the engagement assembly.

15. The method according to claim 13, wherein actuating the engagement assembly comprises engaging upper slips and lower slips against a casing of the wellbore and expanding a packer between the casing and the cylindrical body of the bridge plug.

16. The method according to claim 13, further comprising moving the pin within the housing of the plug assembly via a driving spring.

17. The method according to claim 16, further comprising actuating a release tool in order to release the driving spring and move the pin of the plug assembly.

18. The method according to claim 13, further comprising removing debris from the bridge plug by guiding flow into the wellbore through the bridge plug subsequent to fracturing the frangible component of the plug assembly.

19. The method according to claim 13, further comprising running a fishing operation to return the bridge plug and the plug assembly to a surface.

* * * * *